United States Patent [19]

Kawabata et al.

[11] 4,329,123

[45] May 11, 1982

[54] DIAPHRAGM AIR PUMP ASSEMBLY

[75] Inventors: Yasuhiro Kawabata, Anjo; Noriyoshi Shibata, Nagoya, both of Japan

[73] Assignee: Aisin Seiki Kabushiki Kaisha, Kariya, Japan

[21] Appl. No.: 113,079

[22] Filed: Jan. 17, 1980

[30] Foreign Application Priority Data

Jan. 17, 1979 [JP] Japan ..... 54-4100

[51] Int. Cl.[3] ..... F04B 43/06; F01L 23/00

[52] U.S. Cl. ..... 417/393; 91/306; 91/313

[58] Field of Search ..... 417/393; 91/305, 306, 91/313, 341 R

[56] References Cited

U.S. PATENT DOCUMENTS 1,161,787 11/1915 Nickol ..... 91/306

1,920,014 7/1933 Horton et al. ..... 417/393

3,282,167 11/1966 McKenzie ..... 91/306

*Primary Examiner*—Leonard E. Smith

*Attorney, Agent, or Firm*—Finnegan, Henderson, Farabow, Garrett & Dunner

[57] ABSTRACT

A diaphragm air pump assembly in pneumatic association with a vacuum source and an atmospheric air source includes therein two vacuum operational chambers and two pump chambers defined by two interconnected diaphragms upon admission of vacuum to one of the vacuum operated chambers and atmospheric air to the other vacuum operated chamber the diaphragms are moved in one direction due to pressure difference thereby compressing and exhausting the air contained in one of the pump chambers as well as opening one of two normally closed valves. The vacuum is thus admitted into the other vacuum operational chamber while atmospheric air is supplied to one vacuum operated chamber, so that the diaphragms are moved in the other direction thereby compressing and exhausting the air contained in the other pump chamber as well as opening the other normally closed valve. A periodical reciprocation of the diaphragms will accomplish the pumping operation.

7 Claims, 3 Drawing Figures

DIAPHRAGM AIR PUMP ASSEMBLY

BACKGROUND OF THE INVENTION

This invention relates to an air pump assembly and more particularly to a diaphragm air pump assembly provided with diaphragm means actuated by pressure difference between a vacuum and atmospheric air.

A vane air pump assembly has been well-known and proposed in which the rotor is rotatably mounted in the cam ring and provided with a plurality of vanes. The rotor is generally driven by the engine through a pulley resulting in an increase of the engine load. In addition such vane pump assembly is of relatively heavy weight and requires high accuracy in the manufacture of the constituent elements thereof.

SUMMARY OF THE INVENTION

It is, therefore, one of the objects of the invention to provide a diaphragm air pump assembly which may overcome the difficulties in the conventional air pump assembly.

It is another object of the invention to provide a diaphragm air pump assembly which is simple in construction and reliable in operation.

It is a further object of the invention to provide a diaphragm air pump assembly which effects the pumping operation simply by supplying vacuum thereto.

According to the invention, the diaphragm air pump assembly includes first and second vacuum operated chambers into which vacuum is alternatively admitted by first and second valves. The first and second valves are alternatively actuated by a reciprocal piston which is supplied with vacuum controlled by first and second normally closed valves.

These and other objects will become apparent from reading the specification and viewing the drawings.

DETAILED DESCRIPTION OF THE INVENTION

Figure 1:
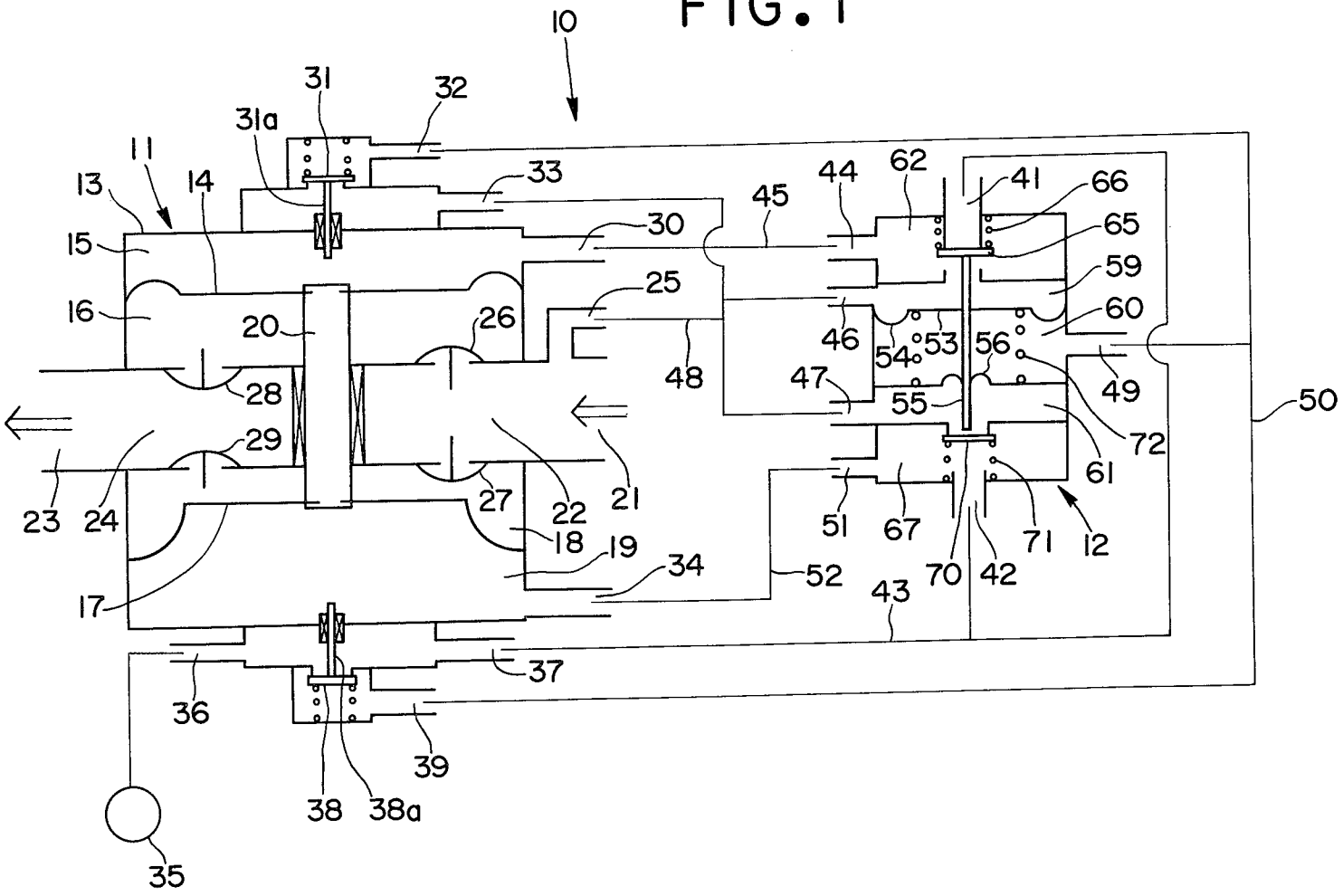
FIG. 1 is a schematic representation of a diaphragm air pump assembly in accordance with the present invention.

Referring now to the drawings, a diaphragm air pump assembly 10 of the invention generally comprises a pump device 11 and a control device 12 as schematically shown in FIG. 1.

Figure 2:
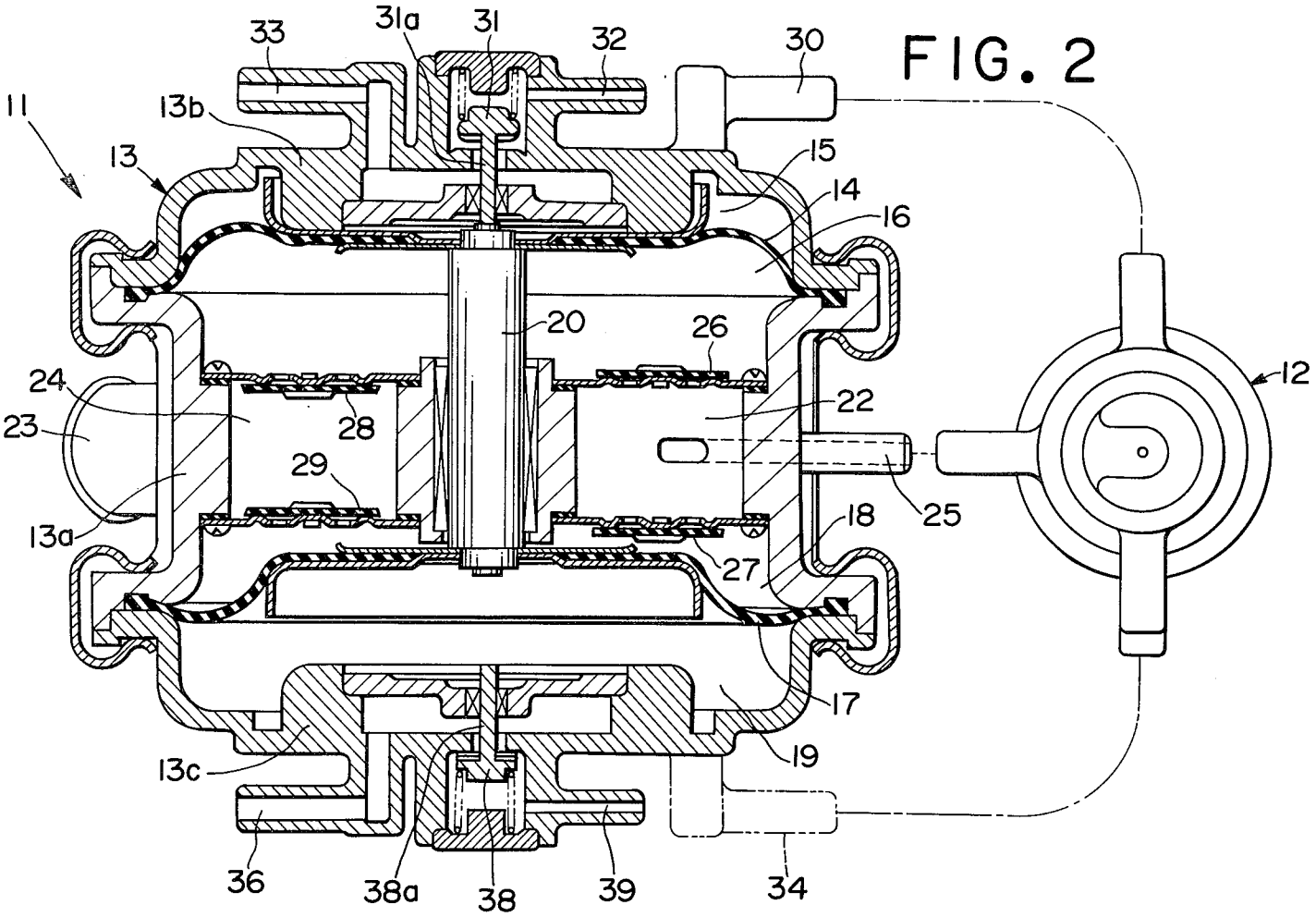
FIG. 2 is a longitudinal section of a pump device of the diaphragm air pump assembly of FIG. 1.

The pump device 11 includes a body 13 composed of body elements 13*a*, 13*b* and 13*c* secured to each other as illustrated in FIG. 2. The interior constituted by the body elements 13*a* and 13*b* is divided into an upper vacuum operated chamber 15 and a lower pump chamber 16 by a diaphragm 14 while the interior constituted by the body elements 13*a* and 13*c* is divided into an upper pump chamber 18 and a lower vacuum operated chamber 19 by a diaphragm 17. The outer periphery of the diaphragm 14 is air-tightly secured between the body elements 13*a* and 13*b* while the outer periphery of the diaphragm 17 is air-tightly secured between the body elements 13*a* and 13*c*. The diaphragms 14 and 17 are connected to each other by a vertically extending rod 20 which is slidably passed through and guided by the center portion of the body element 13*a* in an air-tight manner.

The body element 13*a* of the body 13 is provided with an air inlet port 21, a passage 22 through which the air at the inlet point 21 may be admitted to the pump chambers 16 and 18, an air outlet port 23, a passage 24 through which the air in the pump chambers 16 and 18 is admitted into the outlet port 23, and a port 25 which is in normal pneumatic communication with the passage 22. One-way check valves 26 and 27 for air suction are disposed between the passage 22 and the pump chambers 16 and 18 while one-way check valves 28 and 29 for air exhaust are disposed between the passage 24 and the pump chambers 16 and 18.

The body element 13*b* of the body 13 is provided with a port 30 which is in normal pneumatic communication with the vacuum operated chamber 15 and a pair of ports 32 and 33 which are in pneumatic communication with each other only upon opening of a normally closed valve 31 mounted in the body element 13*b*. The normally closed valve 31 is provided with a rod portion 31*a* disposed coaxially to the vertically extending rod 20 and projected into the vacuum operated chamber 15 and is opened by the rod 20 when the rod 20 is moved up above a predetermined level.

The body element 13*c* of the body 13 is provided with a port 34 which is in normal pneumatic communication with the vacuum operational chamber 19, a port 36 which is in normal communication with a vacuum source 35 such as an intake manifold of an engine, a port 37 which is in normal communication with the port 36, and a port 39 which is in pneumatic communication with the port 36 only when a normally closed valve 38 disposed within the body element 13*c* is open. The normally closed valve 38 is provided with a rod portion 38*a* disposed coaxially to the rod 20 and projected into the vacuum operational chamber 19 and is opened by the rod 20 when the rod 20 is moved down below a predetermined level.

Figure 3:
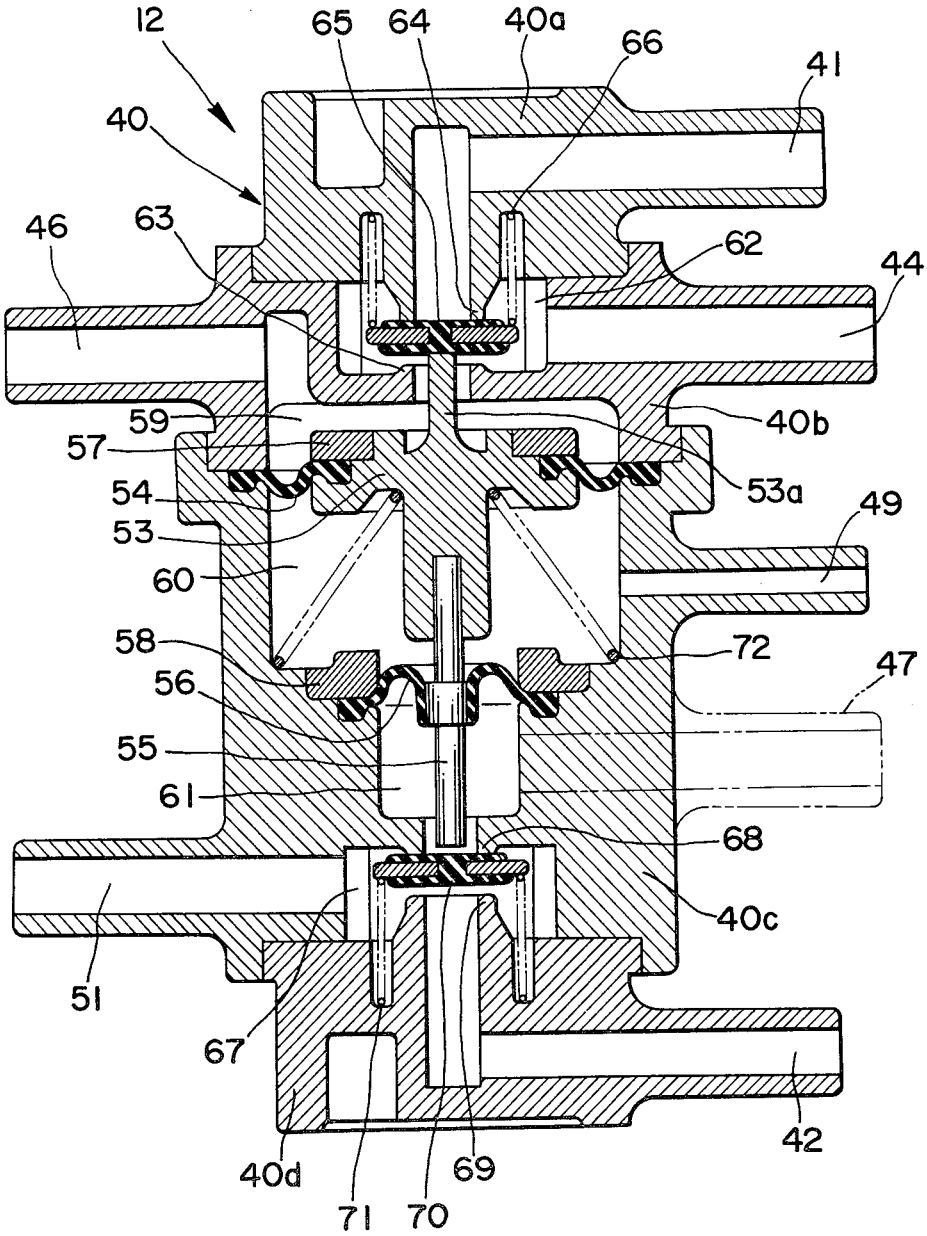
FIG. 3 is a longitudinal section of a control device of the diaphragm air pump assembly of FIG. 1.

The control device 12 as shown in FIGS. 1 to 3, will be explained hereunder. A body 40 of the control device 12 is composed of body elements 40*a*, 40*b*, 40*c* and 40*d* (see FIG. 3) secured to each other. A port 41 provided on the body element 40*a* and a port 42 provided on the body element 40*d* are pneumatically connected to each other by a pipe 43 which leads to the port 37 of the pump device 11. A port 44 provided on the body element 40*b* is pneumatically connected to the port 30 of the pump device 11 by a pipe 45. A port 46 provided on the body element 40*b* and a port 47 provided on the body element 40*c* are pneumatically connected to the ports 25 and 33 of the pump device 11 by a pipe 48. A port 49 provided on the body element 40*c* is pneumatically connected to the ports 32 and 39 of the pump device 11 by a pipe 50. A port 51 on the body element 40*c* is pneumatically connected to the port 34 of the pump device 11 through a pipe 52.

The upper interior defined by the body elements 40*b* and 40*c* is provided with a piston 53 and a diaphragm 54 fixed thereto while the lower interior defined thereby is provided with a rod 55 and a diaphragm 56 fixed thereto.

The outer periphery of the diaphragm 54 is air-tightly secured between the body elements 40*b* and 40*c* while the inner periphery thereof is air-tightly fixed to the piston 53 by means of a retainer 57. The outer periphery of the diaphragm 56, the diameter of which is considerably smaller than that of the diaphragm 54 is air-tightly secured to the body element 40*c* by means of a retainer 58 while the inner periphery thereof is air-tightly secured to the rod 55 fixed to the piston 53. Thus, the interior defined by the body elements 40*b* and 40*c* is divided into an atmospheric pressure chamber 59 connected to the port 46, a variable pressure chamber 60 connected to the port 49, and an atmospheric pressure chamber 61 connected to the port 47 by the piston 53, the diaphragm 54, the rod 55 and the diaphragm 56.

The piston 53 and the rod 55 are normally urged to move up by a helical spring 72 interposed between the body element 40*c* and the piston 53, but is moved down upon admission of vacuum to the variable pressure chamber 60.

A chamber 62 formed between the body elements 40*a* and 40*b* is in normal pneumatic communication with the port 44 and is in communication with the atmospheric pressure chamber 59 through the hole of a valve seat 63 on the body element 40*b* or with the port 41 through the hole of a valve seat 64 on the body element 40*a*.

A valve member 65 movable between the seats 63 and 64 is normally urged to move down by a spring 66 the exerting force of which is smaller than that of the spring 72, but is brought into sealing engagement with the valve seat 64 due to the upward movement of a rod portion 53*a* of the piston 53.

Similarly, a chamber 67 formed by the body elements 40*c* and 40*d* is in normal communication with the port 51 and in communication with the atmospheric chamber 61 through the hole of a valve seat 68 on the body element 40*c* or with the port 42 through the hole of a valve seat 69 on the body element 40*d*. A valve member 70 movable between the seats 68 and 69 is normally urged to move up by a spring 71 but may be brought into sealing engagement with the valve seat 69 due to the downward movement of the rod 55.

Insofar as no vacuum is generated at the vacuum source 35, the variable pressure chamber 60 of the control device 12 is supplied with atmospheric pressure to maintain the piston 53 and the rod 55 in the upward direction by the spring 72. Thus, the valve member 65 is seated on the valve seat 64 whilst the valve member 70 is seated on the valve seat 68, as shown in FIG. 3. As a result, the port 44 of the control device 12 is isolated from the port 41 and connected to the port 46 via atmospheric pressure chamber 59. The port 51 is isolated from the port 47 and connected to the port 42. As for the pump device 11, atmospheric air is supplied to the vacuum operational chambers 15 and 19 thereby maintaining the normally closed valves 31 and 38 in a closed condition.

When vacuum is generated, for instance, by actuation of the engine, the ports 41 and 42 of the control device 12 are supplied with a vacuum via ports 36, 37 and pipe 43. The vacuum supplied to the port 42 is also supplied to the port 51 through the chamber 67 and then to the vacuum operational chamber 19 of the pump device 11 through the pipe 52 and the port 34. The vacuum operational chamber 15 is kept under atmospheric pressure by atmospheric connection with the air inlet port 21 through port 30, pipe 45, port 44, chamber 62, atmospheric pressure chamber 59, port 46, pipe 48, port 25 and the passage 22. Accordingly, the pressure differential between the vacuum operational chambers 15 and 19 causes the diaphragms 14 and 17, in unison with the vertically extending rod 20, to move down. Thus, the air contained in the pump chamber 16 is exhausted into the air outlet port 23 through the one-way check valve 28 and the passage 24. Simultaneously, the air at the inlet port 21 is sucked into the pump chamber 19 through the passage 22 and the one-way check valve 27.

The further downward movement of the diaphragms 14 and 17 in unison with the rod 20 opens the normally closed valve 38 due to mechanical abutment of the rod 20 against the rod portion 38*a* of the valve 38. As a consequence, the port 39 of the pump device 11 is pneumatically associated with the port 36 to admit the vacuum into the variable pressure chamber 60 of the control device 12 through the pipe 50 and the port 49 to thereby move the piston 53 and the rod 55 downward. The valve member 65 is, therefore, released from the valve seat 64 by action of the spring 66 to seat on the valve seat 63 thereby permitting pneumatic communication between ports 41 and 44 while the valve member 70 is released from the valve seat 68 to seat on the valve seat 69 thereby permitting pneumatic communication between ports 47 and 51. Therefore, the vacuum being admitted into the port 41 of the control device 12 is also admitted into the vacuum operational chamber 15 of the pump device 11 via the chamber 62 of the control device 12, port 44, pipe 45 and port 30 while atmospheric air being supplied to the port 47 from the air inlet port 21 is supplied to the vacuum operational chamber 19 via chambers 61 and 67, port 51, pipe 52 and port 34 of the pump device 11.

The diaphragms 14 and 17 in unison with the rod 20 are thus moved up to exhaust the air contained in the pump chamber 17 to the air outlet port 23 through the one way check valve 29 and passage 24 simultaneously to suck the air into the pump chamber 16 from the air inlet port 21 through the passage 22 and the one-way check valve 26, as well as to close the normally closed valve 38.

When the rod 20 is moved up above a predetermined value, the rod portion 31*a* of the normally closed valve 31 is brought into mechanical abutment against the rod 20 to thereby open the valve 31. Accordingly the air at the inlet port 21 is supplied to the variable pressure chamber 60 through the passage 22, port 25, pipe 48, port 33, port 32, pipe 50 and port 49 of the control device 12 with the results that the constituent elements of the control device 12 are returned to their original positions as illustrated in FIG. 3 and the vacuum operational chamber 19 of the pump device is supplied with vacuum while the vacuum operational chamber 15 is supplied with atmospheric air. The diaphragms 14 and 17 in unison with the rod 20 are again moved down to close the normally closed valve 31.

Such periodical reciprocation of the diaphragms 14 and 17 in unison with the rod 20 in the vertical direction effects the pumping operation by alternative admission of air to the pump chambers 16 and 18.

Although a specific embodiment of the invention has been shown and described, it is obvious that many modifications thereof are possible. The invention, therefore, is not intended to be restricted to the exact showing of the drawings and description thereof, but is considered to include reasonable and obvious equivalents.

What is claimed is:

1. A diaphragm air pump assembly adapted for use in pneumatic association with a vacuum source and an atmospheric air source, comprising in combination: a pump device including a pump body, first and second pump diaphragms mounted in said body and dividing the interior of said body into first and second pump chambers and first and second vacuum operational chambers, a vertically extending rod interconnecting said first and second diaphragms and movable in unison therewith; a control device for said pump device including a control body, a first valve member in said control body for controlling admission of vacuum to said first vacuum operational chamber, a second valve member in said control body for controlling admission of vacum to said second vacuum operational chamber, reciprocable means interposed between said first and second valves and movable to alternatively actuate said first and second valves thereby admitting the vacuum alternatively to said first and second vacuum operational chambers, first and second control diaphragms fixed at their outer portions to said control body and at their inner portions to said reciprocable means and defining a movable pressure chamber in said body which is movable with said reciprocable means, a first normally closed valve interposed between said vacuum source and said variable pressure chamber and actuated to open when said first and second pump diaphragms in unison with said rod are moved in one direction, and a second normally closed valve interposed between said atmospheric air source and said variable pressure chamber and actuated to open when said first and second pump diaphragms in unison with said rod are moved in the other direction, whereby the alternative admission of vacuum to said first and second vacuum operational chambers effect the pumping operation by alternative admission of air to said first and second pump chambers.

2. A diaphragm air pump assembly as set forth in claim 1 wherein each of said normally closed valves is provided with a rod portion disposed in coaxial relationship with said vertically extending rod.

3. A diaphragm air pump assembly as set forth in claim 1, further comprising one-way check valves provided between said first and second pump chambers for air sucking and exhausting.

4. A diaphragm air pump assembly as set forth in claim 1, further comprising a first pipe for pneumatic connection of said vacuum source to said first and second valve members of said control device, a second pipe for pneumatic connection of said reciprocal means with said first and second normally closed valves, a third pipe for pneumatic connection of said first valve member with said first vacuum operational chamber, a fourth pipe for pneumatic connection of said second valve member with said second vacuum operational chamber, and a fifth pipe for pneumatic connection of said atmospheric air source with said first and second valve members and one of said normally closed valves.

5. A diaphragm air pump assembly as set forth in claim 1 wherein said reciprocal means comprises a piston and a rod having said first and second diaphragms fixed thereto, respectively, said second diaphragm being smaller than said first diaphragm.

6. A diaphragm air pump assembly as set forth in claim 5 wherein said first and second valve members are disposed at opposed ends of said piston and rod to be actuated thereby.

7. A diaphragm air pump assembly as set forth in claim 6, further comprising a helical spring for normally bringing said piston into abutment against said first valve member.

* * * * *